US009115612B2

(12) United States Patent
Hayashi et al.

(10) Patent No.: US 9,115,612 B2
(45) Date of Patent: Aug. 25, 2015

(54) VALVE TIMING CONTROL DEVICE

(71) Applicant: DENSO CORPORATION, Kariya, Aichi-pref. (JP)

(72) Inventors: Masashi Hayashi, Okazaki (JP); Haruhisa Shibata, Okazaki (JP); Isao Hattori, Gifu (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/296,394

(22) Filed: Jun. 4, 2014

(65) Prior Publication Data

US 2014/0360449 A1 Dec. 11, 2014

(30) Foreign Application Priority Data

Jun. 7, 2013 (JP) ..... 2013-121145

(51) Int. Cl.
*F01L 1/34* (2006.01)
*F01L 1/344* (2006.01)

(52) U.S. Cl.
CPC ..... *F01L 1/3442* (2013.01); *F01L 2001/34479* (2013.01)

(58) Field of Classification Search
CPC ..... F01L 1/3442; F01L 2001/34479
USPC ..... 123/90.15, 90.17
See application file for complete search history.

(56) References Cited

U.S. PATENT DOCUMENTS 6,032,626 A 3/2000 Haag
8,499,732 B2 * 8/2013 Watanabe ..... 123/90.17

FOREIGN PATENT DOCUMENTS

JP 2001-059574 3/2001
JP 2002-122008 4/2002
JP 2002-256823 9/2002
JP 2005-3181 1/2005
JP 2005-344586 12/2005

OTHER PUBLICATIONS

U.S. Appl. No. 14/018,454, in the name of Hayashi, filed on Sep. 5, 2013.
Office Action (2 pages) dated Jun. 23, 2015, issued in corresponding Japanese Application No. 2013-121145 and English translation (4 pages).

* cited by examiner

*Primary Examiner* — Ching Chang
(74) *Attorney, Agent, or Firm* — Nixon & Vanderhye PC

(57) ABSTRACT

A sealing member is supported by a holding surface of a vane rotor and slides on a sealing surface formed by an inner surface of a housing rotor, so as to seal an advancing chamber and a retarding chamber from each other. The sealing member has a pressure-receiving surface and a diffuser surface. The pressure-receiving surface receives pressure of working fluid from a working chamber in a direction to the sealing surface. The diffuser surface forms a sealing gap between the diffuser surface and the sealing surface, so that the sealing surface becomes larger as the sealing surface is more separated from the working chamber in a circumferential direction. The sealing member has a deformable portion forming the pressure-receiving surface and the diffuser surface. The deformable portion is elastically deformed, so that the diffuser surface is more strongly pushed to the sealing surface, when the pressure of the working fluid is increased.

11 Claims, 11 Drawing Sheets

VALVE TIMING CONTROL DEVICE

CROSS REFERENCE TO RELATED APPLICATION

This application is based on Japanese Patent Application No. 2013-121145 filed on Jun. 7, 2013, the disclosure of which is incorporated herein by reference.

FIELD OF TECHNOLOGY

The present disclosure relates to a hydraulic-type valve timing control device for controlling valve opening and/or valve closing timing by adjusting fluid pressure of working fluid, wherein an intake and/or exhaust valve of an internal combustion engine is operated by a cam shaft to which engine torque is transmitted from a crank shaft of the engine.

BACKGROUND

A hydraulic-type valve timing control device is known in the art. A conventional valve timing control device of this kind has a housing rotor and a vane rotor, each of which is rotated in its circumferential direction in synchronism with rotation of a crank shaft and a camshaft of an engine. The valve timing control device adjusts a rotational phase of the vane rotor with respect to the housing rotor (hereinafter simply referred to as the rotational phase). In the valve timing control device, an inside of the housing rotor is divided into multiple spaces by the vane rotor, so that multiple advancing chambers and retarding chambers are formed in the circumferential direction. When working fluid is introduced into the advancing chambers while working fluid is discharged from the retarding chambers, the rotational phase is advanced. On the other hand, when the working fluid is introduced into the retarding chambers while the working fluid is discharged from the advancing chambers, the rotational phase is retarded.

In a conventional device, for example, disclosed in Japanese Patent Publication No. 2005-344586, an advancing chamber and a retarding chamber, which are neighboring to each other in a circumferential direction, are sealed from each other by a sealing member provided at an outer peripheral wall of a vane rotor and sliding on an inner peripheral surface of a housing rotor.

However, the valve timing control device of the above prior art (JP 2005-344586) may have following problems.

When working fluid is supplied to the advancing chamber or the retarding chamber, pressure of working fluid is applied to the sealing member. Therefore, it is necessary to increase a force for pushing the sealing member to the inner peripheral surface of the housing rotor, in order to maintain a desired sealing effect even when the pressure of the working fluid is increased. However, a problem may occur due to the pressure increase of the working fluid. Namely, when the working fluid is supplied to the advancing chamber or to the retarding chamber, a rotational force is generated for rotating the vane rotor relative to the housing rotor. The sealing member receives sliding frictional force from inner peripheral surface of the housing rotor, when the vane rotor is rotated relative to the housing rotor. The sliding frictional force is increased as the pushing force for the sealing member is increased. Therefore, when the pressure of the working fluid is increased, the larger rotational force is generated against the sliding frictional force. However, when the pressure of the working fluid is decreased, a relative ratio of the sliding frictional force with respect to the rotational force becomes larger. As a result, response of rotating the vane rotor relative to the housing rotor may be remarkably decreased.

For example, when operation of an engine is stopped, such a condition occurs in which the working fluid is supplied neither to the advancing chamber nor to the retarding chamber. When the above condition continues for a long period, another problem may occur.

Namely, when the working fluid is supplied to the advancing chamber or the retarding chamber in a normal operation, liquid film of the working fluid is formed between the inner peripheral surface of the housing rotor and the sealing member. However, when the working fluid is not supplied to the advancing chamber or the retarding chamber for the long period, a condition that the liquid film of the working fluid is not formed may also continue for the long period. Then the sealing member may be fixed or adhered to the inner peripheral surface of the housing rotor.

In particular, in the valve timing control device, in which the sealing effect is obtained when the pressure of the working fluid is increased, the sealing member is more likely to be strongly fixed to the housing rotor because the force for pushing the sealing member to the inner peripheral surface of the housing rotor is increased.

SUMMARY OF THE DISCLOSURE

The present disclosure is made in view of the above problems. It is an object of the present disclosure to provide a hydraulic-type valve timing control device, according to which sealing function of a sealing member is brought out when pressure of working fluid is increased, response of the valve timing control device is maintained and the sealing member is prevented from being fixed to or adhered to an opposing surface (for example, an inner peripheral surface of a housing rotor).

According to one of features of the present disclosure, a hydraulic-type valve timing control device is applied to an internal combustion engine for controlling an opening and/or closing timing of a valve, in which engine torque is transmitted from a crank shaft of the engine to a cam shaft in order to open and/or close the valve.

The control device has a housing rotor to be rotated in a circumferential direction in synchronism with the crank shaft. The housing rotor has multiple shoes, each of which extends in a radial-inward direction from a housing body of a cylindrical shape. The housing rotor defines multiple vane accommodating chambers in the circumferential direction between neighboring shoes.

The control device has a vane rotor to be rotated in the circumferential direction in synchronism with the cam shaft. The vane rotor is rotatably accommodated in the housing rotor so that a rotational phase of the vane rotor with respect to the housing rotor is adjusted. The vane rotor has multiple vanes, each of which extends in a radial-outward direction from a rotating shaft and is accommodated in each of the vane accommodating chambers so that an advancing chamber and a retarding chamber are formed in the circumferential direction in each of the vane accommodating chamber. The rotational phase of the vane rotor is advanced when working fluid is introduced into the advancing chamber and working fluid is discharged from the retarding chamber, and the rotational phase of the vane rotor is retarded when the working fluid is introduced into the retarding chamber and the working fluid is discharged from the advancing chamber.

The control device has a sealing member supported by a holding surface and sliding on a sealing surface for sealing the advancing chamber and the retarding chamber from each other, wherein the holding surface is formed by one of an inner peripheral surface of the housing rotor and an outer peripheral surface of the vane rotor, and the sealing surface is formed by the other of the inner peripheral surface of the housing rotor and the outer peripheral surface of the vane rotor.

The sealing member is composed of a pressure-receiving surface, a diffuser surface and a deformable portion.

The pressure-receiving surface receives pressure of the working fluid from a working chamber, which is either one of the advancing chamber and the retarding chamber. The pressure of the working fluid is directed toward the sealing surface.

The diffuser surface forms a sealing gap between the diffuser surface and the sealing surface in a radial direction of the vane rotor. The sealing gap is increased as the sealing gap is more separated from the working chamber in the circumferential direction. The diffuser surface diffuses the working fluid flowing through the sealing gap.

The deformable portion has the pressure-receiving surface and the diffuser surface. The deformable portion keeps the diffuser surface at an initial position when the pressure of the working fluid is not applied to the pressure-receiving surface so that the diffuser surface is separated from the sealing surface. The diffuser surface is more strongly pushed to the sealing surface as the pressure of the working fluid applied to the pressure-receiving surface is increased.

The sealing member supported by the holding surface receives the pressure of the working fluid from the working chamber, wherein the pressure is directed to the sealing surface. As a result, the deformable portion is more strongly deformed so as to push the diffuser surface to the sealing surface, when the pressure of the working fluid applied to the pressure-receiving surface is increased. In the sealing gap, which becomes larger as the sealing gap is more separated from the working chamber, the working fluid is diffused to generate pressure loss. Therefore, the pressure loss becomes larger in accordance with pressure increase of the working fluid from the working chamber.

When the pressure loss is increased in the sealing gap in accordance with the pressure increase of the working fluid at the pressure-receiving surface, the diffuser surface facing to the sealing gap is attracted toward the sealing surface. The elastic deformation of the deformable portion becomes larger by such attracting movement and thereby a force for pushing the diffuser surface to the sealing surface is increased. As a result, the sealing effect can be obtained even when the pressure of the working fluid is increased.

On the other hand, when the pressure of the working fluid at the pressure-receiving surface is decreased, the pressure loss generated in the sealing gap facing to the diffuser surface is correspondingly decreased. As a result, the pushing force for pushing the diffuser surface toward the sealing surface is decreased and thereby sliding frictional force applied from the sealing surface to the diffuser surface is correspondingly decreased. Therefore, even when the rotational force for rotating the vane rotor relative to the housing rotor is decreased in accordance with the pressure decrease in the working chamber, a relative ratio of the sliding frictional force to the rotational force is decreased. Accordingly, it is possible to suppress the decrease of the response.

When the working fluid is supplied into neither the advancing chamber nor the retarding chamber, the pressure of the working fluid is not applied from the working chamber (the advancing chamber or the retarding chamber) to the pressure-receiving surface. Then, the deformable portion returns to its initial position, and the diffuser surface is separated from the sealing surface. Even when a longer time period passes by in a condition that the working fluid is not supplied to any of the advancing chamber and the retarding chamber, it is possible to prevent the diffuser surface from being fixed to or adhered to the sealing surface.

According to another feature of the present disclosure, the pressure-receiving surface is formed in the deformable portion on a side to the holding surface, while the diffuser surface is formed in the deformable portion on a side to the sealing surface.

According to the features of the present disclosure, the pressure-receiving surface formed on the side to the holding surface receives the pressure of the working fluid from the working chamber, while the diffuser surface formed on the side to the sealing surface receives the pressure of the working fluid in the sealing gap. According to the above structure, it is possible to increase the following capability of the deformable portion for elastically deforming in accordance with the pressure loss in the sealing gap. As a result, the sealing effect can be surely maintained at the pressure increase of the working fluid, while the response is properly prevented from being decreased at the pressure decrease of the working fluid.

According to another feature of the present disclosure, the sealing member has a rigid portion, which is more rigid than the deformable portion, wherein the rigid portion swings by the elastic deformation of the deformable portion. The pressure-receiving surface is formed on one of surfaces of the rigid portion on a side to the holding surface, while the diffuser surface is formed on the other of the surfaces of the rigid portion on a side to the sealing surface.

According to the above feature of the present disclosure, when each of the pressure-receiving surface and the diffuser surface of the rigid portion receives the pressure of the working fluid from the working chamber and the pressure of the working fluid in the sealing gap, the deformable portion is elastically deformed so as to swing the rigid portion. According to the above structure, since the shape of the diffuser surface is stable until the diffuser surface is brought into contact with the sealing surface, the swinging movement of the rigid portion has high following capability depending on the pressure loss in the sealing gap. Accordingly, even according to the above feature, the sealing effect can be surely maintained at the pressure increase of the working fluid, while the response is properly prevented from being decreased at the pressure decrease of the working fluid.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION OF THE EMBODIMENTS

Figure 1:
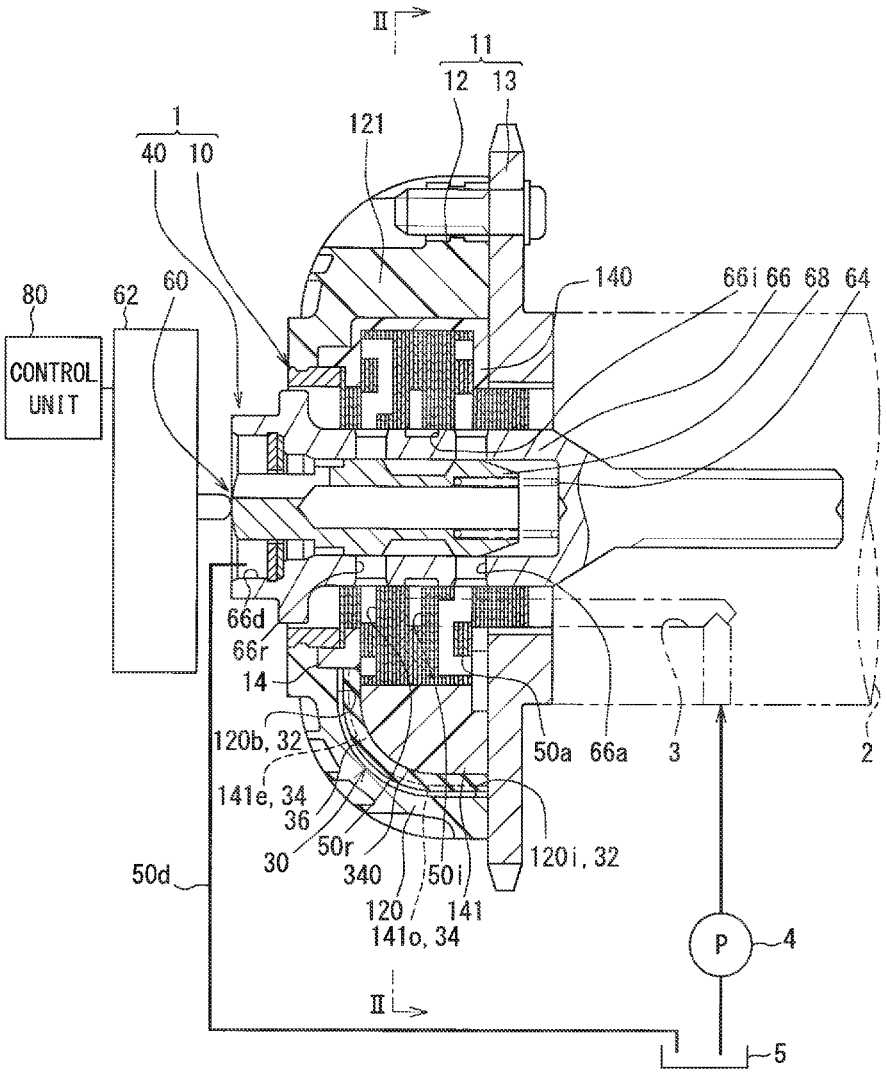
FIG. 1 is a schematic cross sectional view, taken along a line I-I in FIG. 2, showing a hydraulic-type valve timing control device according to a first embodiment of the present disclosure.

The present disclosure will be explained hereinafter by way of multiple embodiments. The same reference numerals are given to the same or similar portions and/or structures throughout the embodiments, for the purpose of eliminating repeated explanation. The following multiple embodiments and/or modifications may be combined together even in a case in which such combination is not explicitly explained.

First Embodiment

Figure 2:
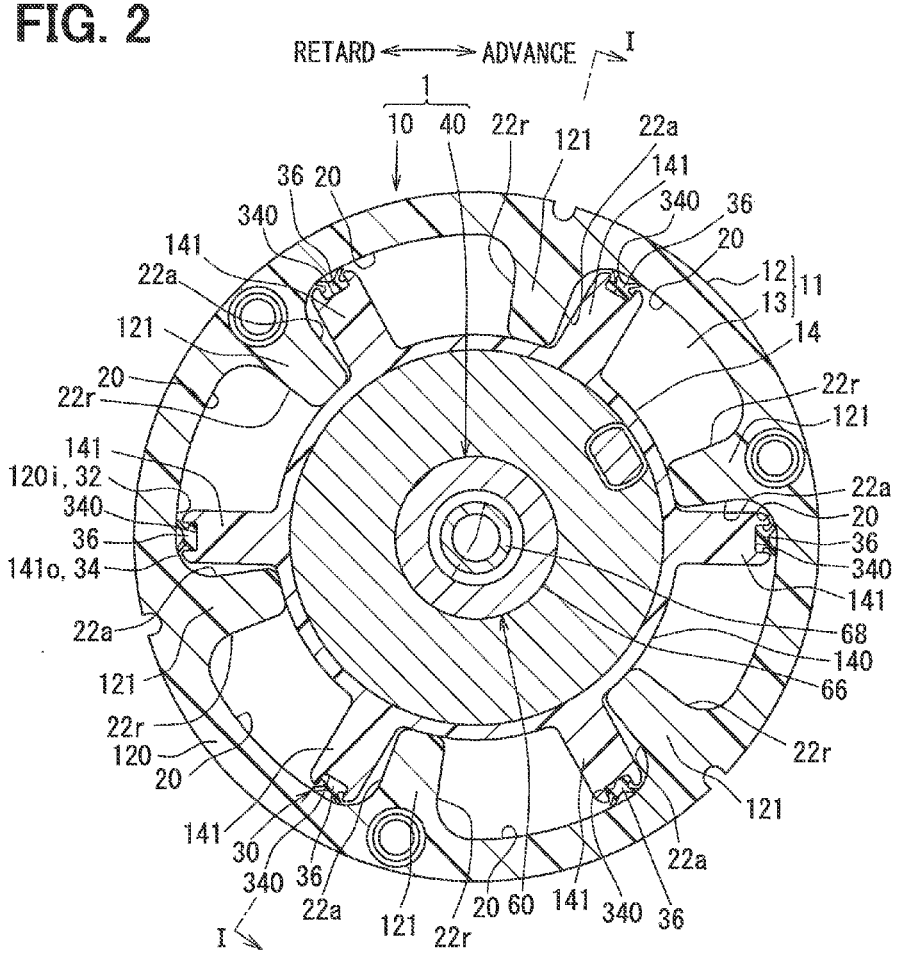
FIG. 2 is a schematic cross sectional view taken along a line II-II in FIG. 1.

As shown in FIGS. 1 and 2, a valve timing control device 1 of a first embodiment of the present disclosure, which is mounted in an internal combustion engine (hereinafter, the engine) of a vehicle, is a hydraulic-type device, wherein fluid pressure of working fluid is used for driving the valve timing control device 1 (hereinafter, the control device 1). The control device 1 adjusts valve opening and/or valve closing timing of an intake valve or an exhaust valve, which is opened and closed by an operation of a cam shaft 2 to which engine torque is transmitted. The control device 1 is composed of a rotation mechanism system 10 and a rotation control system 40. The valve opening and/or closing timing of the intake valve or exhaust valve are collectively referred to as the valve timing.

(Rotation Mechanism System)

At first, a basic structure of the rotation mechanism system 10 will be explained. The rotation mechanism system 10 is provided in a power transmitting path, through which the engine torque outputted from a crank shaft (not shown) of the engine is transmitted to the cam shaft 2. The rotation mechanism system 10 is composed of a housing rotor 11, a vane rotor 14 and so on.

The housing rotor 11 is composed of a shoe housing 12, a sprocket plate 13 and so on. Some portions of the shoe housing 12 are made of metal, while a major portion of the shoe housing 12 is made of resin. The shoe housing 12 has a housing body 120, which is formed in a cylindrical shape having a bottom, and multiple shoes 121. As shown in FIG. 2, the multiple shoes 121 are arranged at equal intervals in a circumferential direction of the housing body 120 and each of the shoes 121 is projected in a radial-inward direction. Multiple vane accommodating chambers 20 are formed between neighboring shoes 121 in the circumferential direction.

The sprocket plate 13 made of metal is formed in a disc shape for covering an open end of the housing body 120. The sprocket plate 13 is connected to the crank shaft of the engine via a timing chain (not shown). During engine operation, the engine torque is transmitted from the crank shaft to the sprocket plate 13, so that the housing rotor 11 is rotated in synchronism with the rotation of the crank shaft (in a clockwise direction in FIG. 2).

As shown in FIGS. 1 and 2, the vane rotor 14 is coaxially arranged with and movably accommodated in the housing rotor 11. Each of axial side surfaces of the vane rotor 14 is in contact with a bottom wall of the shoe housing 12 and the sprocket plate 13 in a sliding manner. The vane rotor 14 has a rotating shaft 140 of a cylindrical shape and multiple vanes 141. The rotating shaft 140 is composed of a laminated body, which is made of multiple metal plates and insert-molded with resin. The rotating shaft 140 is fixed to and coaxially arranged with the cam shaft 2. The vane rotor 14 is rotated together with the cam shaft 2 in the same direction of the housing rotor 11 (in the clockwise direction in FIG. 2). The vane rotor 14 is rotatable relative to the housing rotor 11.

The multiple vanes 141 are arranged at equal intervals in the circumferential direction of the rotating shaft 140. Each of the vanes 141, which is made of the resin integrally formed with the rotating shaft 140, extends in a radial-outward direction. As shown in FIG. 2, each of the vanes 141 divides the vane accommodating chamber 20 of the housing rotor 11 in the circumferential direction into an advancing chamber **22*a* and a retarding chamber 22*r*. Multiple advancing chambers 22*a* and multiple retarding chambers 22*r*** are alternately formed in the circumferential direction.

In the rotation mechanism system 10 of the above structure, the rotational phase for the valve timing is adjusted by controlling supply of working fluid to the advancing chambers **22*a* or the retarding chambers 22*r*. More exactly, when the working fluid is supplied to the advancing chambers 22*a* and the working fluid is discharged from the retarding chambers 22*r*, the vane rotor 14 is rotated relative to the housing rotor 11 in an advancing direction (in the clockwise direction in FIG. 2). In other words, since the rotational phase is adjusted in the advancing direction, the valve timing is correspondingly advanced. On the other hand, when the working fluid is supplied to the retarding chambers 22***r* and the working fluid is discharged from the advancing chambers 22*a*, the vane rotor 14 is rotated relative to the housing rotor 11 in a retarding direction (in an anti-clockwise direction in FIG. 2). In other words, since the rotational phase is adjusted in the retarding direction, the valve timing is correspondingly retarded.

(Rotation Control System)

A basic structure of the rotation control system 40 will be explained. The rotation control system 40 controls supply of the working fluid in order to drive the rotation mechanism system 10.

As shown in FIGS. 1 and 2, the rotation control system 40 has fluid passages 50*a*, 50*r*, 50*i* and 50*d*, a control valve 60 and a control unit 80.

As shown in FIG. 1, an advancing-side fluid passage 50*a* is formed in the rotating shaft 140 and communicated to the advancing chambers 22*a*. A retarding-side fluid passage 50*r* is also formed in the rotating shaft 140 and communicated to the retarding chambers 22*r*.

A supply-side fluid passage 50*i* is formed in the rotating shaft 140 and communicated to a supply pump 4 (a working-fluid supplying source) via a fuel supply passage 3. The supply pump 4 is a mechanical pump, which is driven by the engine torque during the engine operation, and pumps out the working fluid sucked from a drain pan 5. The cam shaft 2 as well as the fuel supply passage 3, which penetrates through a bearing for the cam shaft 2, is connected to an outlet port of the supply pump 4. According to the above structure, the working fluid is introduced into the supply-side fluid passage 50*i* from the supply pump 4, when the engine operation is started. The supply of the working fluid to the supply-side fluid passage 50*i* is cut off, when the engine operation is stopped.

A drain-side fluid passage 50*d* is formed outside of the rotation mechanism system 10 and the cam shaft 2 and opened to the atmosphere. The drain-side fluid passage 50*d* discharges the working fluid to the drain pan 5.

As shown in FIGS. 1 and 2, the control valve 60 is a so-called spool valve, according to which a spool 68 is operated within a sleeve 66.

As shown in FIG. 1, in the control valve 60, the spool 68 is moved back and forth in an axial direction of the cam shaft 2 depending on a balance between a driving force generated at a linear solenoid 62 and a spring force of a return spring 64. Multiple ports 66*a*, 66*r*, 66*i* and 66*d* are formed in the sleeve 66 of the control valve 60. An advancing-side port 66*a* is communicated to the advancing-side fluid passage 50*a*, a retarding-side port 66*r* is communicated to the retarding-side fluid passage 50*r*, a supply-side port 66*i* is communicated to the supply-side fluid passage 50*i*, and a drain-side port 66*d* is communicated to the drain-side fluid passage 50*d*. In the above control valve 60, when an axial position of the spool 68 with respect to the sleeve 66 is changed, the supply of the working fluid to the advancing chambers 22*a* or the retarding chambers 22*r* is changed. Namely, communications between the multiple ports 66*a*, 66*r*, 66*i* and 66*d* and the advancing chambers 22*a* and the retarding chambers 22*r* are switched over from an advancing mode to a retarding mode, or vice versa.

The control unit 80 is composed of an electronic circuit mainly formed by a micro-computer. The control unit 80 is connected to the linear solenoid 62. The control unit 80 carries out control of the engine (including the control of power supply to the linear solenoid 62) in accordance with computer program memorized in a memory device of the control unit 80.

According to the above rotation control system 40, the communication mode between the ports 66*a*, 66*r*, 66*i* and 66*d* and the advancing and retarding chambers 22*a* and 22*r* is changed in accordance with the power supply control to the linear solenoid 62 by the control unit 80. More exactly, when the supply-side port 66*i* is communicated to the advancing-side port 66*a* and the drain-side port 66*d* is communicated to the retarding-side port 66*r*, the working fluid is supplied to the advancing chambers 22*a* and the working fluid is discharged from the retarding chambers 22*r* so as to realize the advancing adjustment for the valve opening and/or closing timing of the intake valve (or the exhaust valve). On the other hand, when the supply-side port 66*i* is communicated to the retarding-side port 66*r* and the drain-side port 66*d* is communicated to the advancing-side port 66*a*, the working fluid is supplied to the retarding chambers 22*r* and the working fluid is discharged from the advancing chambers 22*a* so as to realize the retarding adjustment for the valve opening and/or closing timing of the intake valve (or the exhaust valve).

(Self-Sealing Structure)

A self-sealing structure 30 shown in FIGS. 1 and 2 will be explained more in detail. The self-sealing structure 30 is composed of multiple sealing members 36 provided between a sealing surface 32 and a holding surface 34 of the rotation mechanism system 10.

Figure 5:
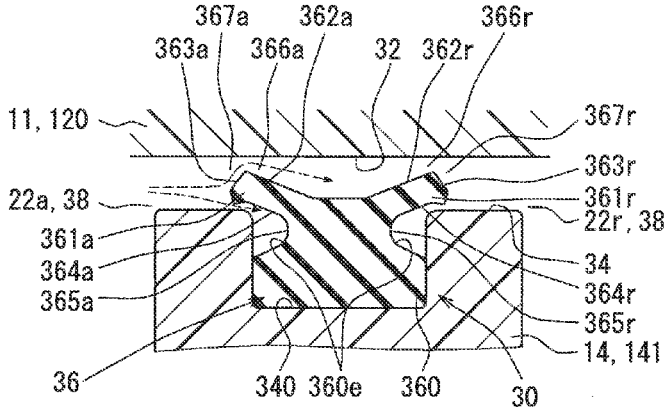
FIG. 5 is a schematically enlarged cross sectional view of a relevant part of FIG. 2 showing the sealing member and its related portions, which are in a certain operating condition.

In the first embodiment, as shown in FIG. 5, the sealing surface 32 is formed by an inner surface of the housing rotor 11, while the holding surface 34 is formed by an outer surface of the vane rotor 14.

More exactly, the housing body 120 has multiple inner peripheral surfaces 120*i* and bottom surfaces 120*b* (on a left-hand side in FIG. 1), wherein each of the inner peripheral surfaces 120*i* and each of the bottom surfaces 120*b* form each of the vane accommodating chambers 20. The sealing surface 32 is formed in each of the vane accommodating chambers 20 by the inner peripheral surface 120*i* and the bottom surface 120*b*. Each of the vanes 141 of the vane rotor 14 has an outer peripheral surface 1410 and an axial end surface 141*e* (on the left-hand side in FIG. 1). The holding surface 34 is formed by the outer peripheral surface 1410 and the axial end surface 141*e*. A sealing-member accommodating groove 340 (hereinafter, the groove 340) is formed at the holding surface 34 of each vane 141 of the vane rotor 14, wherein the groove 340 is recessed in a direction opposite to the sealing surface 32 (at each point where the holding surface 34 and the sealing surface 32 are opposed to each other).

As shown in FIG. 1, the groove 340 is formed in an L-letter shape on a cross-sectional plane including an axis of the vane rotor 14, wherein the groove 340 extends from a radial-inside end portion of the axial end surface 141*e* of the vane 141 to an axial end portion of the outer peripheral surface 1410 of the vane 141. The radial-inside end portion of the axial end surface 141*e* is located on a left-hand side of the vane 141 in FIG. 1, while the axial end portion of the outer peripheral surface 1410 is located on a right-hand side of the vane 141 in FIG. 1.

As shown in FIG. 2, the groove 340 is formed in a rectangular shape on a cross-sectional plane perpendicular to the axis of the vane rotor 14.

Each of the sealing members 36 is provided between the groove 340 formed in the holding surface 34 and the sealing surface 32. Since a structure of each sealing member 36 is identical to one another, one of the sealing members 36 will be explained as a representative example. In the following explanation, a rotational direction of the vane rotor 14 and a rotational direction of the housing rotor 11, which are the same to each other, will be referred to as simply "the rotational direction" or "circumferential direction".

Figure 3:
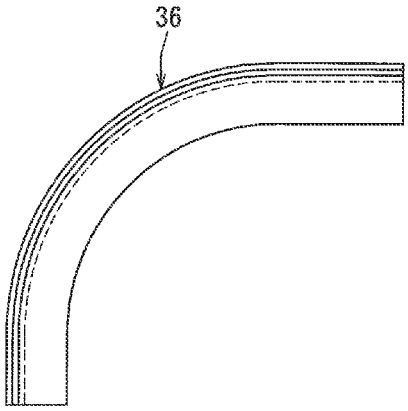
FIG. 3 is a schematically enlarged side view showing a sealing member in FIGS. 1 and 2.
Figure 4:
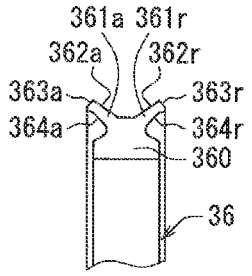
FIG. 4 is a schematic front view showing the sealing member in FIGS. 1 and 2.

As shown in FIGS. 3 and 4, the sealing member 36 is made of elastic material, such as rubber, and formed in the L-letter shape. As shown in FIGS. 1 and 2, the sealing member 36 is provided between the corresponding sealing surface 32 and the holding surface 34, wherein the sealing member 36 extends along the groove 340 from the radial-inside end portion of the axial end surface 141*e* of the vane 141 (which corresponds also a radial-inside end portion of the bottom surface 120*b* of the housing body 120) to the axial end portion of the outer peripheral surface 1410 of the vane 141. The sealing member 36 is partly accommodated in and held by the groove 340 and slides on the sealing surface 32 in accordance with the relative movement of the vane rotor 14 to the housing rotor 11, in order to seal the advancing chamber 22*a* and the retarding chamber 22*r* from each other, wherein the advancing chamber 22*a* and the retarding chamber 22*r* are formed between the neighboring vanes 141 in the circumferential direction. In other words, the advancing chamber 22*a* and the retarding chamber 22*r*, which are neighboring to each other over the vane 141 in the circumferential direction, are fluid-tightly sealed from each other.

As shown in FIGS. 4 and 5, the sealing member 36 has a base portion 360, a first elastically deformable portion 361*a* (hereinafter, the first deformable portion 361*a*), a second elastically deformable portion 361*r* (hereinafter, the second deformable portion 361*r*), a first diffuser surface 362*a*, a second diffuser surface 362*r*, a first guide surface 363*a*, a second guide surface 363*r*, a first pressure-receiving surface 364*a* and a second pressure-receiving surface 364*r*. The above portions of the sealing member 36 are integrally formed as one unit for the sealing member 36 along its entire length. The above first portions 361*a*, 362*a*, 363*a* and 364*a* are provided on a side of the advancing chamber 22*a* (which is located on the left-hand side in FIGS. 4 and 5, although not shown in FIGS. 4 and 5), while the above second portions 361*r*, 362*r*, 363*r* and 364*r* are provided on a side of the retarding chamber 22*r* (which is located on the right-hand side in FIGS. 4 and 5). The base portion 360 is formed as a portion commonly used for the advancing side and the retarding side.

In the present disclosure, each of the advancing chamber 22*a* and the retarding chamber 22*r* is also referred to as a working chamber 38 or collectively referred to as the working chamber 38. The working chamber 38 for a first group of the portions 361*a*, 362*a*, 363*a* and 364*a* corresponds to the advancing chamber 22*a*, while the working chamber 38 for a second group of the portions 361*r*, 362*r*, 363*r* and 364*r* corresponds to the retarding chamber 22*r*.

As shown in FIG. 5, the base portion 360 is formed in a thick wall shape and its entire portion is inserted into the groove 340. The first deformable portion 361*a* is projected from a radial-outer end 360*e* of the base portion 360 in a direction to the working chamber 38 (that is, the advancing chamber 22*a*). The radial-outer end 360*e* is an end of the base portion 360 on a side to the sealing surface 32 in a radial direction of the vane rotor 14. As a result of the above structure, a first communication groove 365*a*, which is communicated to the working chamber 38 (the advancing chamber 22*a*), is formed between the base portion 360 and the first deformable portion 361*a*. Ina similar manner to the above structure, the second deformable portion 361*r* is projected from the radial-outer end 360*e* of the base portion 360 in a direction to the working chamber 38 (that is, the retarding chamber 22*r*). According to the projecting structure of the second deformable portion 361*r*, a second communication groove 365*r*, which is communicated to the working chamber 38 (the retarding chamber 22*r*), is formed between the base portion 360 and the second deformable portion 361*r*. According to the above structure, the base portion 360 receives pressure of the working fluid from the working chamber 38 via either the first communication groove 365*a* or the second communication groove 365*r*, so that the base portion 360 is pushed by the working fluid in a direction to an inside surface of the groove 340.

The first group of the portions 361*a*, 362*a*, 363*a* and 364*a* of the sealing member 36 for the advancing side will be further explained.

The first deformable portion 361*a* is formed in a thin-walled shape extending from the base portion 360 toward the sealing surface 32. The first deformable portion 361*a* protrudes from the groove 340 to an outside of the holding surface 34. The first diffuser surface 362*a* is formed at an outer-side surface of the first deformable portion 361*a*, that is, at a surface on a radial-outer side of the first deformable portion 361*a* facing to the sealing surface 32. The first deformable portion 361*a* is inclined in the rotational direction with respect to the sealing surface 32, so that a first sealing gap 366*a* formed in the radial direction of the vane rotor 14 between the first diffuser surface 362*a* and the sealing surface 32 becomes larger as the first sealing gap 366*a* is more separated from the working chamber 38 (the advancing chamber 22*a*) in the circumferential direction. An inclined surface of the first diffuser surface 362*a* is maintained independently of the deformation of the first deformable portion 361*a*. The working fluid flowing from the working chamber 38 (the advancing chamber 22*a*) through the first sealing gap 366*a* is diffused by the first diffuser surface 362*a* having the above inclined surface.

The first guide surface 363*a* is formed at a forward end surface of the first deformable portion 361*a*. The first guide surface 363*a* is located at a position closer to the working chamber (the advancing chamber 22*a*) than the first diffuser surface 362*a*. The first guide surface 363*a* is connected to the first diffuser surface 362*a* in the circumferential direction. The first guide surface 363*a* is inclined with respect to the sealing surface 32, so that a first guide gap 367*a* formed in the radial direction of the vane rotor 14 between the first guide surface 363*a* and the sealing surface 32 becomes smaller as the first guide gap 367*a* is more separated from the working chamber 38 (the advancing chamber 22*a*) in the circumferential direction. In other words, the first guide surface 363*a* has an inclined surface, which is inclined in a reversed direction of the first diffuser surface 362*a*. The inclined surface of the first guide surface 363*a* is maintained independently of the deformation of the first deformable portion 361*a*. The working fluid flowing from the working chamber 38 (the advancing chamber 22*a*) is guided in the direction to the first diffuser surface 362*a* by the first guide surface 363*a* having the above inclined surface.

The first pressure-receiving surface 364*a* is formed on a surface of the first deformable portion 361*a* opposite to the first diffuser surface 362*a*. The first pressure-receiving surface 364*a* forms the first communication groove 365*a* along an inclined surface of the first pressure-receiving surface 364*a*, which is almost parallel to the first diffuser surface 362*a*. The first pressure-receiving surface 364*a* receives the pressure of the working fluid flowing from the working chamber 38 (the advancing chamber 22*a*) in the direction toward the sealing surface 32.

Figure 6:
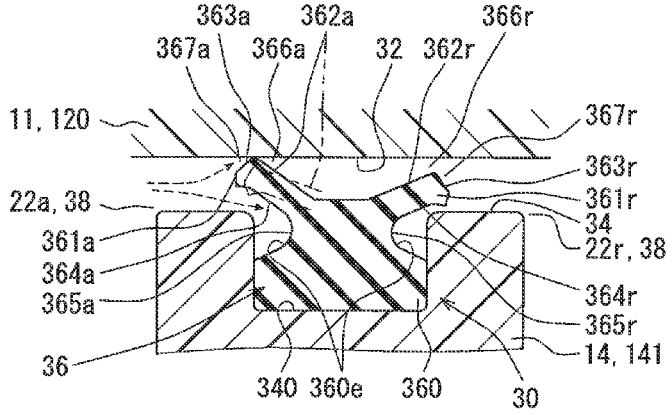
FIG. 6 is a schematically enlarged cross sectional view showing the sealing member and its related portions, which are in another operating condition.
Figure 7:
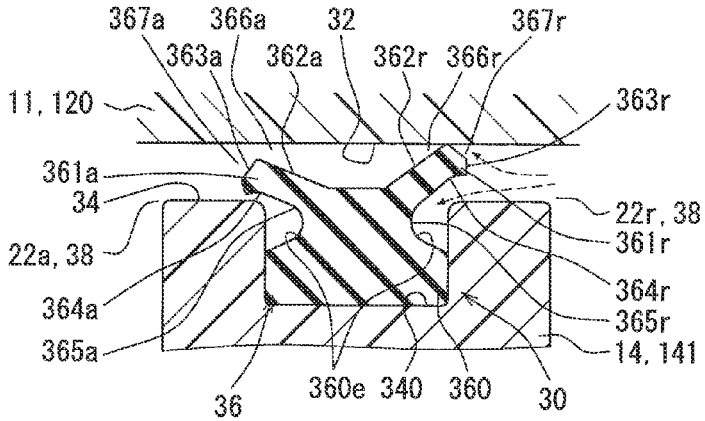
FIG. 7 is also a schematically enlarged cross sectional view showing the sealing member and its related portions, which are in a further different operating condition.

The first deformable portion 361*a* is in its initial position, when the first pressure-receiving surface 364*a* does not receive the pressure of the working fluid, as shown in FIG. 5. In the initial position, the first diffuser surface 362*a* is separated from the sealing surface 32. When the pressure of the working fluid applied to the first pressure-receiving surface 364*a* is increased, the first deformable portion 361*a* is elastically deformed as shown in FIG. 6. In a condition of the deformation of the first deformable portion 361*a*, the first diffuser surface 362*a* is pushed toward the sealing surface 32 and the forward end of the first deformable portion 361*a* is brought into contact with the sealing surface 32.

A thickness of the forward end (including the first guide surface 363*a*) of the first deformable portion 361*a* in the radial direction between the first pressure-receiving surface 364*a* and the first diffuser surface 362*a* is made larger than those of other portions of the first deformable portion 361*a*. In other words, the thickness of the first deformable portion 361*a* between the first pressure-receiving surface 364*a* and the first diffuser surface 362*a* is increased in the direction toward the working chamber 38 (the advancing chamber 22*a*). According to such a shape of the first deformable portion 361*a*, the inclined shape of the first diffuser surface 362*a* is maintained at an upstream side of the first diffuser surface 362*a* (that is, at an entrance of the first sealing gap 366*a*), when the pressure of the working fluid applied to the first pressure-receiving surface 364*a* is increased and the first deformable portion 361*a* is thereby elastically deformed.

As above, each of the portions of the first group 361*a*, 362*a*, 363*a*, 364*a*, 365*a*, 366*a* and 367*a* of the above structure works in connection with the advancing chamber 22*a*. Although detailed explanation is eliminated, each of the portions of the second group 361*r*, 362*r*, 363*r*, 364*r*, 365*r*, 366*r* and 367*r* has the same structure and function to those of the corresponding portions of the first group 361*a*, 362*a*, 363*a*, 364*a*, 365*a*, 366*a* or 367*a* and works in connection with the retarding chamber 22*r* in the same manner to that for the advancing chamber 22*a*.

As explained above, the first pressure-receiving surface 364*a* of the sealing member 36 held by the holding surface 34 (accommodated in and supported by the groove 340) receives the pressure of the working fluid, which is supplied into the working chamber 38 (the advancing chamber 22*a*), in the direction toward the sealing surface 32 in the operation for the advancing control. Therefore, as shown in FIG. 6, the first diffuser surface 362*a* is more strongly pushed to the sealing surface 32 and thereby the first deformable portion 361*a* is more largely deformed, when the pressure of the working fluid applied to the first pressure-receiving surface 364*a* of the sealing member 36 is increased. The first deformable portion 361*a* maintains its inclined shape (indicated by a one-dot-chain line in FIG. 6) until the forward end of the first deformable portion 361*a* is brought into contact with the sealing surface 32. In the inclined shape of the first deformable portion 361*a*, the first sealing gap 366*a* becomes larger as the first sealing gap 366*a* is more separated from the working chamber 38 (the advancing chamber 22*a*) in the circumferential direction for the entire circumferential length of the first deformable portion 361*a*. As a result, pressure loss generated by the diffusion of the working fluid flowing from the working chamber 38 (the advancing chamber 22*a*) through the first sealing gap 366*a* becomes larger in accordance with the pressure increase of the working fluid from the working chamber 38.

On the other hand, in the operation for the retarding control, the second pressure-receiving surface 364*r* of the sealing member 36 held by the holding surface 34 (accommodated in and supported the groove 340) receives the pressure of the working fluid, which is supplied into the working chamber 38 (the retarding chamber 22*r*), in the direction toward the sealing surface 32. Therefore, the second deformable portion 361*r* is elastically deformed so as to push the second diffuser surface 362*r* to the sealing surface 32 in the same manner to the operation for the advancing control. As a result, pressure loss generated by the diffusion of the working fluid flowing from the working chamber 38 (the retarding chamber 22*r*) through the second sealing gap 366*r* becomes larger in accordance with the pressure increase of the working fluid from the working chamber 38.

As above, since the pressure loss is increased at the first sealing gap 366*a* (or at the second sealing gap 366*r*) when the pressure of the working fluid applied to the first pressure-receiving surface 364*a* (or to the second pressure-receiving surface 364*r*) becomes larger, the first diffuser surface 362*a* (or the second diffuser surface 362*r*) is pulled toward the sealing surface 32. When the first deformable portion 361*a* (or the second deformable portion 361*r*) is more largely deformed by the above pulling effect, the pushing force for pushing the first diffuser surface 362*a* (or the second diffuser surface 362*r*) toward the sealing surface 32 is increased. As a result, even when the pressure of the working fluid is increased, the desired sealing effect can be maintained. In this operation, since the first or the second deformable portion 361*a* or 361*r* of the thin-plate shape is elastically deformed by the pushing force, each of longitudinal ends in its extending direction is tightly pushed to the rotating shaft 140 and the sprocket plate 13 (as shown in FIG. 1) to thereby increase the sealing effect.

On the other hand, the pressure loss is decreased at the first sealing gap 366*a* (or at the second sealing gap 366*r*) when the pressure of the working fluid applied to the first pressure-receiving surface 364*a* (or to the second pressure-receiving surface 364*r*) becomes smaller. Then, the pushing force for pushing the first diffuser surface 362*a* (or the second diffuser surface 362*r*) toward the sealing surface 32 is decreased. As a result, a sliding frictional force, which the first diffuser surface 362*a* or the second diffuser surface 362*r* receives from the sealing surface 32, is decreased.

Accordingly, even when the rotational driving force for relatively rotating the vane rotor 14 with respect to the housing rotor 11 is decreased as a result of the pressure decrease of the working fluid in the working chamber 38 (the advancing or the retarding chamber 22*a* or 22*r*), a relative ratio of the sliding frictional force to the rotational driving force is decreased so that deterioration of the response is prevented.

In addition, when the working fluid is not introduced into the advancing chamber 22*a* or the retarding chamber 22*r*, the pressure of the working fluid from the working chamber 38 (the advancing chamber 22*a* or the retarding chamber 22*r*) is not applied to the first pressure-receiving surface 364*a* or the second pressure-receiving surface 364*r*. Since the first and second deformable portions 361*a* and 361*r* return to their initial positions, as shown in FIG. 5, it is possible to prevent the first and second diffuser surfaces 362*a* and 362*r* from being fixed to or adhered to the sealing surface 32 even when a long period of time passes over since the working fluid is not supplied to the advancing or the retarding chamber 22*a* or 22*r*.

According to the sealing member 36 of the present embodiment, the first guide gap 367*a* or the second guide gap 367*r* (hereinafter, the guide gap 367*a*/367*r*) is maintained between the sealing surface 32 and the first guide surface 363*a* or the second guide surface 363*r* (hereinafter, the guide surface 363*a*/363*r*), which is connected to the first diffuser surface 362*a* or the second diffuser surface 362*r* (hereinafter, the diffuser surface 362*a*/362*r*) on the side closer to the working chamber 38. And the guide gap 367*a*/367*r* becomes smaller as the guide gap 367*a*/367*r* is more separated from the working chamber 38 in the circumferential direction. According to the guide gap 367*a*/367*r*, the working fluid flowing from the working chamber 38 is guided along the guide surface 363*a*/363*r* toward the diffuser surface 362*a*/362*r*. Accordingly, the working fluid surely flows from the guide gap 367*a*/367*r* into the first sealing gap 366*a* or the second sealing gap 366*r* (hereinafter, the sealing gap 366*a*/366*r*), which is formed between the sealing surface 32 and the diffuser surface 362*a*/362*r*. The pressure loss is thereby generated depending on the pressure of the working fluid flowing into the sealing gap 366*a*/366*r*. Accordingly, it is possible to surely maintain the sealing effect even in the case that the pressure of the working fluid is increased. Furthermore, it is possible to surely prevent the decrease of the response in the case that the pressure of the working fluid is decreased.

Each of the first and second deformable portions 361*a* and 361*r* (hereinafter, the deformable portion 361*a*/361*r*) directly receives the pressure of the working fluid from the working chamber 38 as well as the pressure of the working fluid in the sealing gap 366*a*/366*r*. More exactly, each of the first and second pressure-receiving surfaces 364*a* and 364*r* (hereinafter, the pressure-receiving surface 364*a*/364*r*) on the side to the holding surface 34 as well as the diffuser surfaces 362*a*/362*r* on the side to the sealing surface 32 receives the pressure of the working fluid. The deformable portion 361*a*/361*r* is elastically deformed depending on the pressure loss at the sealing gap 366*a*/366*r*. In other words, pressure following capability of each deformable portion is increased. As a result, the sealing effect is maintained at the pressure increase of the working fluid, while the response is maintained at the pressure decrease of the working fluid.

At the forward end of each deformable portion 361*a*/361*r*, the thickness between the pressure-receiving surface 364*a*/364*r* and the diffuser surface 362*a*/362*r* is made larger. The inclined shape of the diffuser surface 362*a*/362*r* is maintained at the entrance portion of the sealing gap 366*a*/366*r*. Accordingly, since it is possible to keep a predetermined diffusing function by the diffuser surface 362*a*/362*r* at the entrance portion of the sealing gap 366*a*/366*r*, the pressure loss is surely generated at the sealing gap 366*a*/366*r*. As a result, the sealing effect can be surely brought out at the pressure increase of the working fluid and the response can be surely maintained at the pressure decrease of the working fluid.

In addition, since the base portion 360 of the sealing member 36 is inserted into the groove 340, which is formed at the holding surface 34 and recessed in the direction opposite to the sealing surface 32, displacement and/or distortion of the sealing member 36 with respect to the holding surface 34 hardly occurs. Therefore, the deformable portion 361*a*/361*r* extending from the base portion 360 can be surely and elastically deformed depending on the pressure loss generated in the sealing gap 366*a*/366*r*. As a result, even in this respect, the sealing effect can be surely brought out at the pressure increase of the working fluid and the response can be surely maintained at the pressure decrease of the working fluid.

Furthermore, since the base portion 360 receives the pressure of the working fluid flowing from the working chamber 38 to the groove 340, the base portion 360 is pushed into the groove 340. Therefore, the base portion 360 is not easily pulled out from the groove 340. In other words, the sealing member 36 is not easily separated from the holding surface 34. It is, therefore, possible to continuously keep the elastic deformation of the deformable portion 361*a*/361*r* depending on the pressure loss in the sealing gap 366*a*/366*r*, so long as the pressure of the working fluid is existing in the working chamber 38. As a result, the sealing effect can be surely brought out at the pressure increase of the working fluid and the response can be surely maintained at the pressure decrease of the working fluid.

Furthermore, the sealing member 36 has the first group of the portions, including the first diffuser surface 362*a*, the first pressure-receiving surface 364*a* and so on, which are related to the working chamber 38 of the advancing chamber 22*a*. The sealing member 36 also has the second group of the portions, including the second diffuser surface 362*r*, the second pressure-receiving surface 364*r* and so on, which are related to the working chamber 38 of the retarding chamber 22*r*. The sealing member 36 prevents the leakage of the working fluid in both directions at the sealing gaps 366*a*/366*r* provided between the both of the working chambers 38. In addition, since the sealing member 36 has the first group and the second group of the portions as integral parts to each other, it is possible to increase easiness of assembling the sealing member 36 to the holding surface 34.

Second Embodiment

Figure 8:
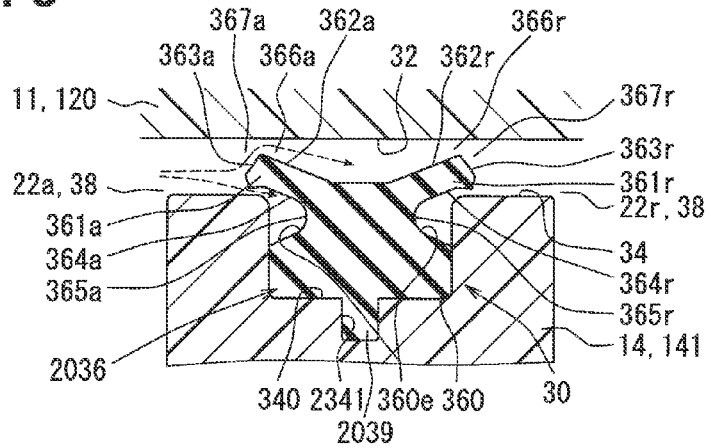
FIG. 8 is a schematically enlarged cross sectional view showing the sealing member and its related portions according to a second embodiment of the present disclosure.

As shown in FIG. 8, a second embodiment is a modification of the first embodiment. In the second embodiment, a fitting hole 2341 is formed at a bottom surface of the groove 340. A sealing member 2036 has an anchoring projection 2039 as an integral part thereof. The anchoring projection 2039 is inserted into the fitting hole 2341, so that the vane 141 more firmly holds the sealing member 2036 at the holding surface 34.

The anchoring projection 2039 is commonly formed for the first group of the portions (including the portions 361*a*, 362*a*, 363*a* and 364*a* related to the advancing chamber 22*a*) and the second group of the portions (including the portions 361*r*, 362*r*, 363*r* and 364*r* related to the retarding chamber 22*r*). The anchoring projection 2039 extends from the base portion 360 accommodated in the groove 340 in the direction opposite to the sealing surface 32. The anchoring projection 2039 is formed in a columnar shape or a square pillar shape. Since the anchoring projection 2039 is press-fitted into the fitting hole 2341, not only the displacement and/or distortion of the sealing member 2036 is prevented or made smaller, but also the sealing member 2036 is not easily pulled out and separated from the holding surface 34.

According to the second embodiment, the pressure of the working fluid is applied to the base portion 360 of the sealing member 2036 in the same manner to the first embodiment. It is, therefore, possible to continuously keep the elastic deformation of the deformable portion 361*a*/361*r* depending on the pressure loss in the sealing gap 366*a*/366*r*, so long as the pressure of the working fluid is existing in the working chamber 38. As a result, in the same manner to the first embodiment, the sealing effect can be surely brought out at the pressure increase of the working fluid and the response can be surely maintained at the pressure decrease of the working fluid.

Third Embodiment

Figure 9:
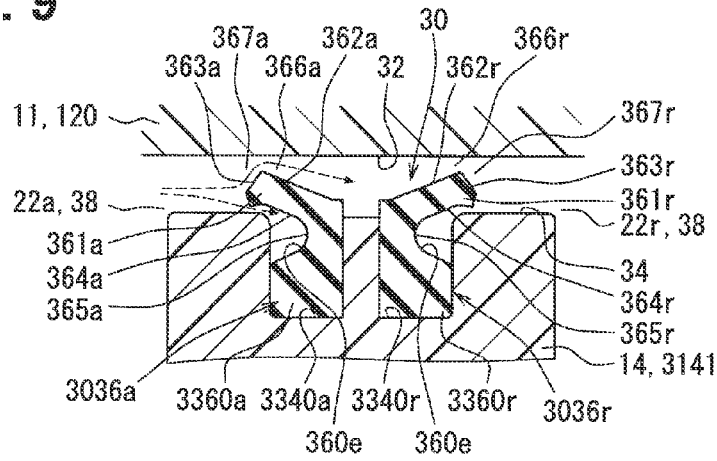
FIG. 9 is a schematically enlarged cross sectional view showing the sealing member and its related portions according to a third embodiment of the present disclosure.

As shown in FIG. 9, a third embodiment is another modification of the first embodiment. In the third embodiment, a pair of (first and second) grooves 3340*a* and 3340*r* is formed in a vane 3141 having the holding surface 34. The first and second grooves 3340*a* and 3340*r* are arranged in the circumferential direction of the vane rotor 14. A first sealing member 3036*a* is held in the first groove 3340*a* on the side to the advancing chamber 22*a*, while a second sealing member 3036*r* is held in the second groove 3340*r* on the side to the retarding chamber 22*r*.

The first sealing member 3036*a*, which is inserted into the first groove 3340*a*, has a base portion 3360*a* in addition to the first group of the portions (including the first deformable portion 361*a*, the first diffuser surface 362*a*, the first guide surface 363*a* and the first pressure-receiving surface 364*a*) on the side to the advancing chamber 22*a*, wherein the first deformable portion 361*a* extends from the base portion 3360*a*. Ina similar manner, the second sealing member 3036*r*, which is inserted into the second groove 3340*r*, has a base portion 3360*r* in addition to the second group of the portions (including the second deformable portion 361*r*, the second diffuser surface 362*r*, the second guide surface 363*r* and the second pressure-receiving surface 364*r*) on the side to the retarding chamber 22*r*, wherein the second deformable portion 361*r* extends from the base portion 3360*r*. The portions other than the above grooves 3340*a* and 3340*r* and the base portions 3360*a* and 3360*r* are the same to those of the first embodiment.

According to the third embodiment, the first sealing member 3036*a* has the first group of the portions (361*a*, 362*a*, 363*a*, 364*a*) for the working chamber 38 (the advancing chamber 22*a*), while the second sealing member 3036*r* has the second group of the portions (361*r*, 362*r*, 363*r*, 364*r*) for the working chamber 38 (the retarding chamber 22*r*). The sealing members 3036*a* and 3036*r* prevent the leakage of the working fluid in both directions at the sealing gaps 366*a* and 366*r* provided between the both of the working chambers 38.

In addition, it is possible to select appropriate dimension (for example, the thickness between the diffuser surface 362*a*/362*r* and the pressure-receiving surface 364*a*/364*r*), shape, material, hardness and so on for each of the sealing members 3036*a* and 3036*r* depending on pressure characteristic of the respective working chambers 38.

Fourth Embodiment

Figure 10:
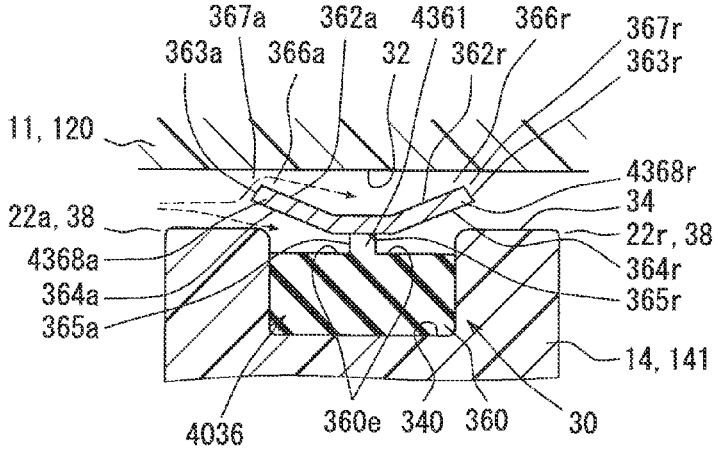
FIG. 10 is a schematically enlarged cross sectional view showing the sealing member and its related portions according to a fourth embodiment of the present disclosure.

As shown in FIG. 10, a fourth embodiment is a further modification of the first embodiment. In the fourth embodiment, a sealing member 4036 has a first rigid portion 4368*a* on the side to the advancing chamber 22*a* and a second rigid portion 4368*r* on the side to the retarding chamber 22*r*. The first rigid portion 4368*a* of the sealing member 4036 has the first group of the portions (including the first diffuser surface 362*a*, the first guide surface 363*a* and the first pressure-receiving surface 364*a*). The second rigid portion 4368*r* of the sealing member 4036 has the second group of the portions (including the second diffuser surface 362*r*, the second guide surface 363*r* and the second pressure-receiving surface 364*r*). The first group of the portions and the second group of the portions are integrally formed as one integral member. The sealing member 4036 has a common deformable portion 4361 connecting the base portion 360 to the one integral member of the first and second rigid portions 4368*a* and 4368*r*.

More exactly, the first and second rigid portions 4368*a* and 4368*r* are made of a metal thin film, a resin film or the like, which is more rigid than the elastic material for the deformable portion 4361 and the base portion 360. In the embodiment of FIG. 10, the rigid portions 4368*a* and 4368*r* are made of the metal thin film. In each of the rigid portions 4368*a* and 4368*r*, the diffuser surface 362*a*/362*r* is formed on a surface of the rigid portion 4368*a*/4368*r* on the side to the sealing surface 32. The guide surface 363*a*/363*r* is formed at each of the forward ends of the rigid portions 4368*a* and 4368*r*. The pressure-receiving surface 364*a*/364*r* is formed on a surface of the rigid portion 4368*a*/4368*r* on the side to the holding surface 34. In the present embodiment, since the pressure-receiving surface 364*a*/364*r* is formed so as be parallel to the diffuser surface 362*a*/362*r* in an area around the forward end of the rigid portion 4368*a*/4368*r*, the thickness of the rigid portion 4368*a*/4368*r* is constant for its entire length in the circumferential direction.

In the sealing member 4036, the communication groove 365*a*/365*r* is formed between the rigid portion 4368*a*/4368*r* and the radial-outer end 360*e* of the base portion 360 and the deformable portion 4361 is formed in a slender shape, so that the deformable portion 4361 is elastically deformable. When the deformable portion 4361 of the slender shape is elastically deformed with respect to the base portion 360, either one of the rigid portions 4368*a* and 4368*r* is inclined and pushed to the sealing surface 32, as shown in FIG. 11 or 12.

According to the sealing member 4036 of the fourth embodiment, the first pressure-receiving surface 364*a* receives the pressure of the working fluid introduced into the working chamber 38 (the advancing chamber 22*a*) during the advancing operation of the valve timing. As a result, the first rigid portion 4368*a* of the sealing member 4036 is pushed in the direction to the sealing surface 32. More exactly, the deformable portion 4361 is elastically deformed more largely when the pressure of the working fluid applied to the first pressure-receiving surface 364*a* is increased, so that the first diffuser surface 362*a* of the first rigid portion 4368*a* is pushed in the direction to the sealing surface 32 as shown in FIG. 11.

Figure 11:
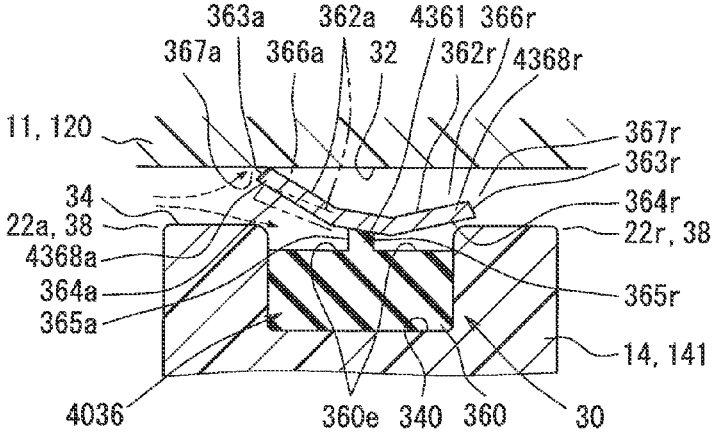
FIG. 11 is a schematically enlarged cross sectional view showing the sealing member and its related portions, which are in a different operating condition from that of FIG. 10.
Figure 12:
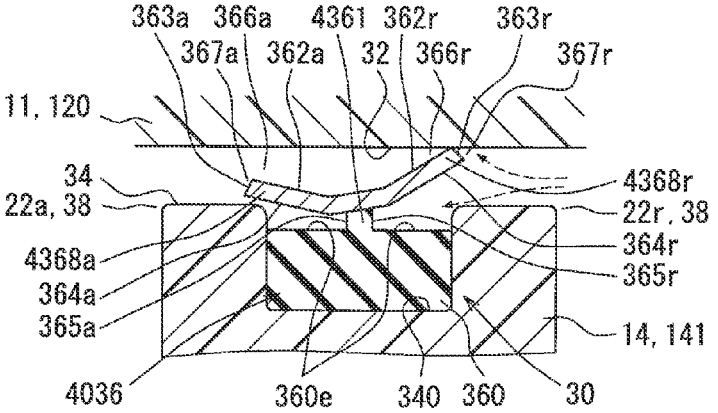
FIG. 12 is also a schematically enlarged cross sectional view showing the sealing member and its related portions, which are in a further different operating condition from that of FIG. 10 and FIG. 11.

Until the sealing member 4036 is inclined and brought into contact with the sealing surface 32 as indicated by a solid line in FIG. 11, the sealing member 4036 maintains its inclined condition as indicated by a two-dot-chain line in FIG. 11, in which the first sealing gap 366*a* becomes larger as the first sealing gap 366*a* is more separated from the working chamber 38 (the advancing chamber 22*a*) in the circumferential direction. As a result, the pressure loss at the first sealing gap 366*a* is increased in accordance with the pressure increase of the working fluid in the working chamber 38 (the advancing chamber 22*a*).

On the other hand, during the retarding operation of the valve timing, the second pressure-receiving surface 364*r* of the sealing member 4036 receives the pressure of the working fluid introduced into the working chamber 38 (the retarding chamber 22*r*). As a result, the second rigid portion 4368*r* of the sealing member 4036 is pushed in the direction to the sealing surface 32. In the same manner for the advancing operation, the deformable portion 4361 is elastically deformed, so that the second diffuser surface 362*r* of the second rigid portion 4368*r* is pushed in the direction to the sealing surface 32 as shown in FIG. 12. Therefore, the pressure loss at the second sealing gap 366*r* is increased in accordance with the pressure increase of the working fluid in the working chamber 38 (the retarding chamber 22*r*).

According to the fourth embodiment, in the same manner to the first embodiment, the sealing effect can be surely brought out at the pressure increase of the working fluid and the response can be surely maintained at the pressure decrease of the working fluid. In addition, the sealing member is prevented from being adhered to the sealing surface.

According to the rigid portion 4368*a*/4368*r* of the sealing member 4036, the pressure-receiving surface 364*a*/364*r* on the side of the holding surface 34 and the diffuser surface 362*a*/362*r* on the side of the sealing surface 32 receive the pressure of the working fluid from the working chamber 38 and the pressure of the working fluid in the sealing gap 366*a*/366*r*. The rigid portion 4368*a*/4368*r* of the sealing member

4036 swings, while the deformable portion 4361 is elastically deformed. Since the shape of the diffuser surface 362*a*/362*r* is stable until the forward end of the rigid portion 4368*a*/4368*r* is brought into contact with the sealing surface 32, the following capability of the rigid portion 4368*a*/4368*r* is increased for the swinging movement of the rigid portion 4368*a*/4368*r* depending on the pressure loss in the sealing gap 366*a*/366*r*. Accordingly, the sealing effect can be surely brought out at the pressure increase of the working fluid and the response can be surely maintained at the pressure decrease of the working fluid.

In addition, the base portion 360 of the sealing member 4036 is inserted into the groove 340, which is formed in the holding surface 34 and recessed in the direction opposite to the sealing surface 32. Therefore, the displacement and/or distortion of the sealing member 4036 with respect to the holding surface 34 hardly occurs. The deformable portion 4361 of the slender shape, which is formed between the rigid portions 4368*a* and 4368*r* and the base portion 360, can be surely and elastically deformed depending on the pressure loss in the sealing gap 366*a*/366*r*. Therefore, the sealing effect can be surely brought out at the pressure increase of the working fluid and the response can be surely maintained at the pressure decrease of the working fluid.

Fifth Embodiment

Figure 13:
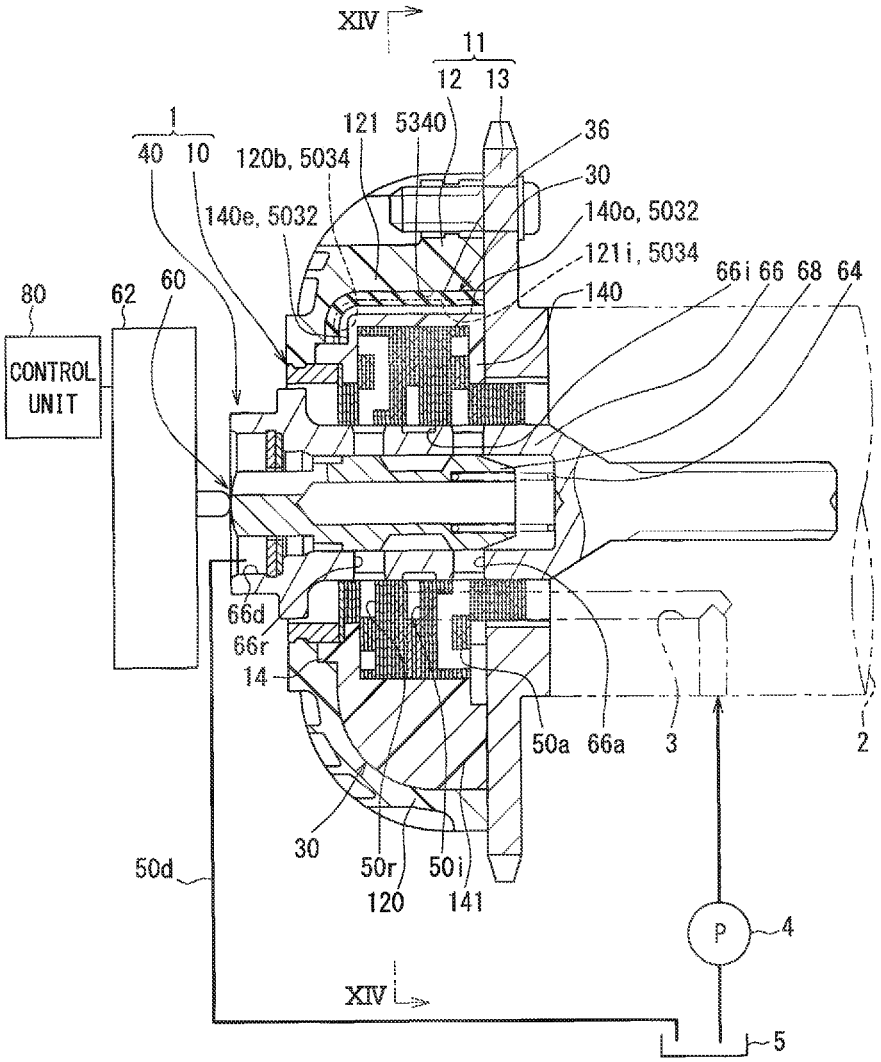
FIG. 13 is a schematic cross sectional view, taken along a line XIII-XIII in FIG. 14, showing a hydraulic-type valve timing control device according to a fifth embodiment of the present disclosure.
Figure 14:
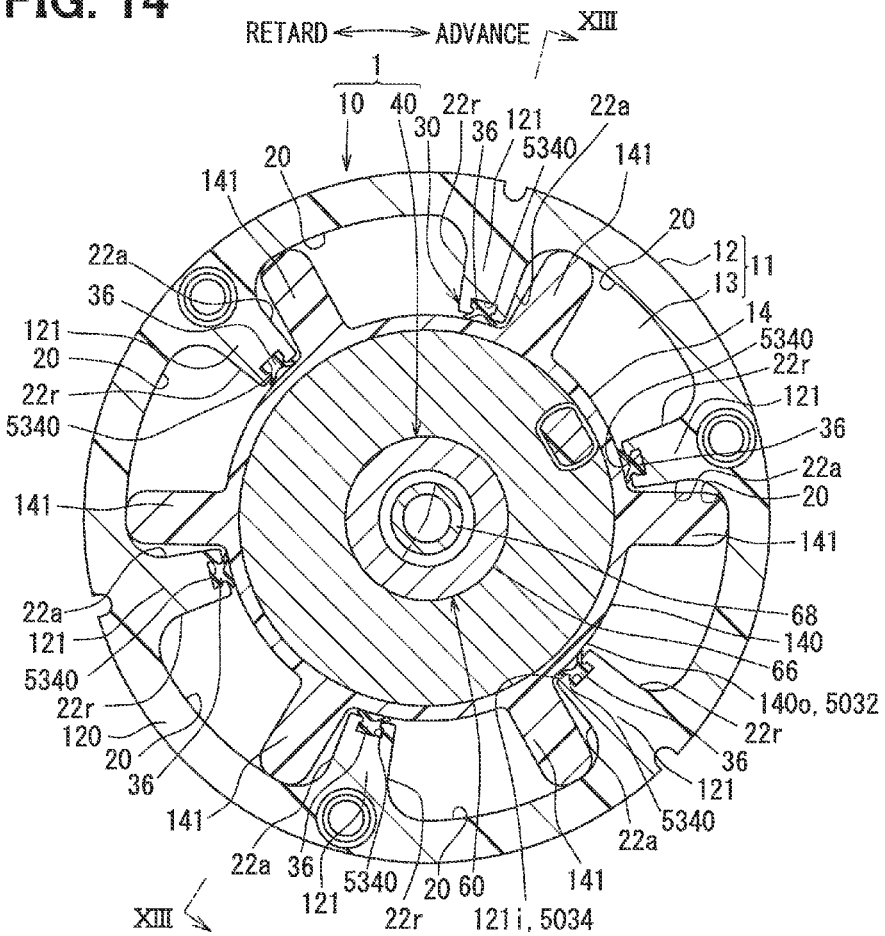
FIG. 14 is a schematic cross sectional view taken along a line XIV-XIV in FIG. 13.
Figure 15:
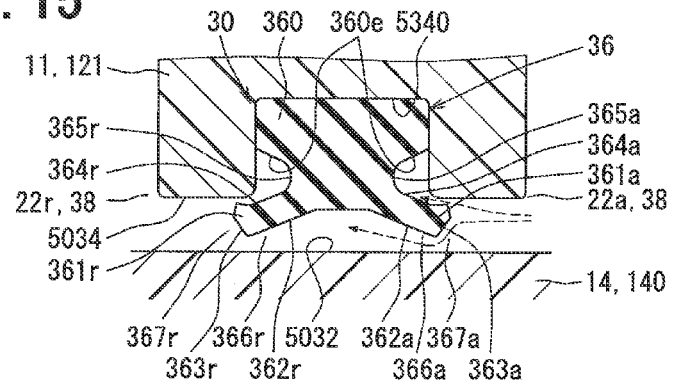
FIG. 15 is a schematically enlarged cross sectional view of a relevant part of FIG. 14 showing the sealing member and its related portions.

As shown in FIGS. 13 to 15, a fifth embodiment is a still further modification of the first embodiment. In the fifth embodiment, an inner surface of the housing rotor 11 (more exactly, an inner surface of each shoe 121) is a holding surface 5034 corresponding to the holding surface 34 of the first embodiment, while an outer surface of the vane rotor 14 (between the neighboring vanes 141) is a sealing surface 5032 corresponding to the sealing surface 32 of the first embodiment.

More in detail, the sealing surface 5032 is composed of a radial-outer surface 1400 of the vane rotor 14 between the neighboring vanes 141 and a part of the axial end surface 140*e* of the rotating shaft 140, wherein the axial end surface 140*e* extends from the radial-outer surface 140*o* in a radial-inward direction as shown in FIG. 13. On the other hand, the holding surface 5034 is composed of a radial-inward surface 121*i* of each shoe 121 and a part of the bottom surface 120*b* of the housing body 120, wherein the bottom surface 120*b* extends from the radial-inward surface 121*i* in the radial-inward direction as shown in FIG. 13. A groove 5340 is formed in the holding surface 5034 of each shoe 121. The groove 5340 is recessed in a direction opposite to the sealing surface 5032 and has a rectangular cross section, as shown in FIGS. 14 and 15. Each of the grooves 5340 has an L-letter shape in a cross sectional plane including the axis of the rotating shaft 140, as shown in FIG. 13. Each of the sealing members 36 is provided between the respective groove 5340 and the sealing surface 5032.

The valve timing control device 1 of the fifth embodiment has the same structure to that of the first embodiment other than the above explained portions, that is, the sealing surface 5032, the holding surface 5034 and the groove 5340. The same advantages to those of the first embodiment can be obtained in the fifth embodiment.

Sixth Embodiment

Figure 16:
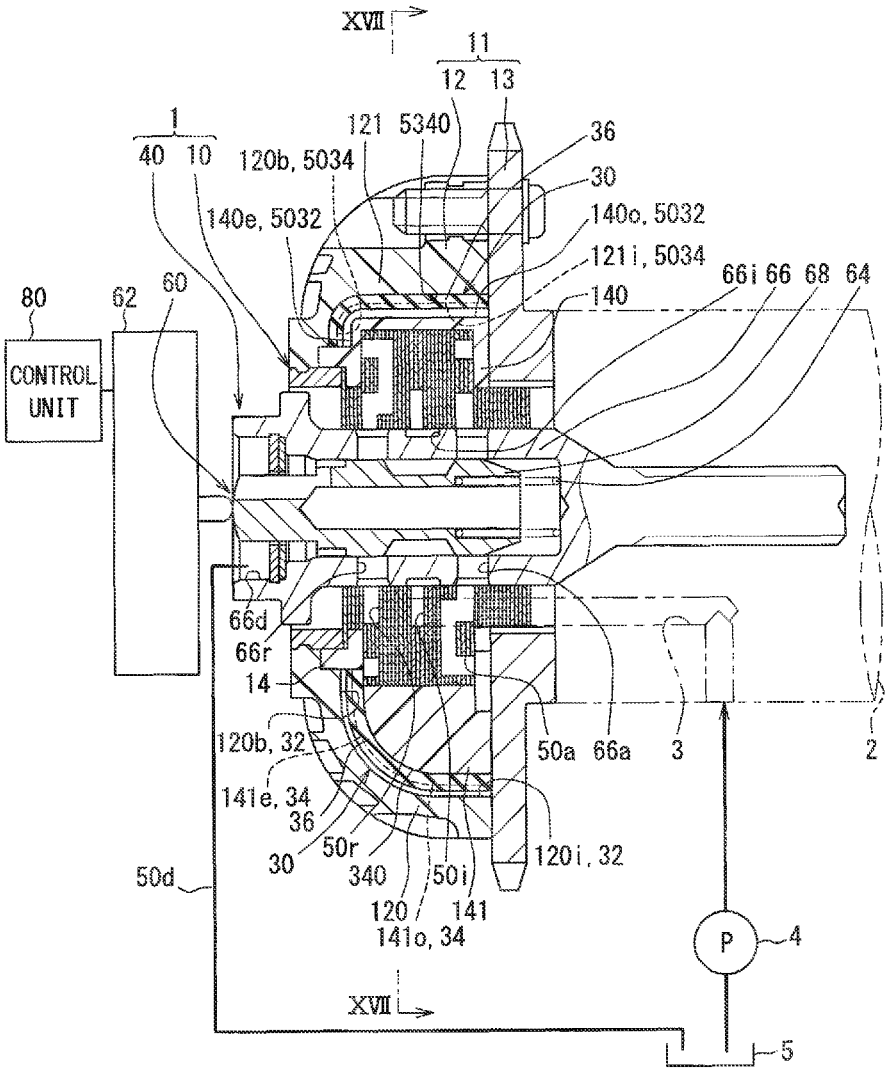
FIG. 16 is a schematic cross sectional view, taken along a line XVI-XVI in FIG. 17, showing a hydraulic-type valve timing control device according to a sixth embodiment of the present disclosure.
Figure 17:
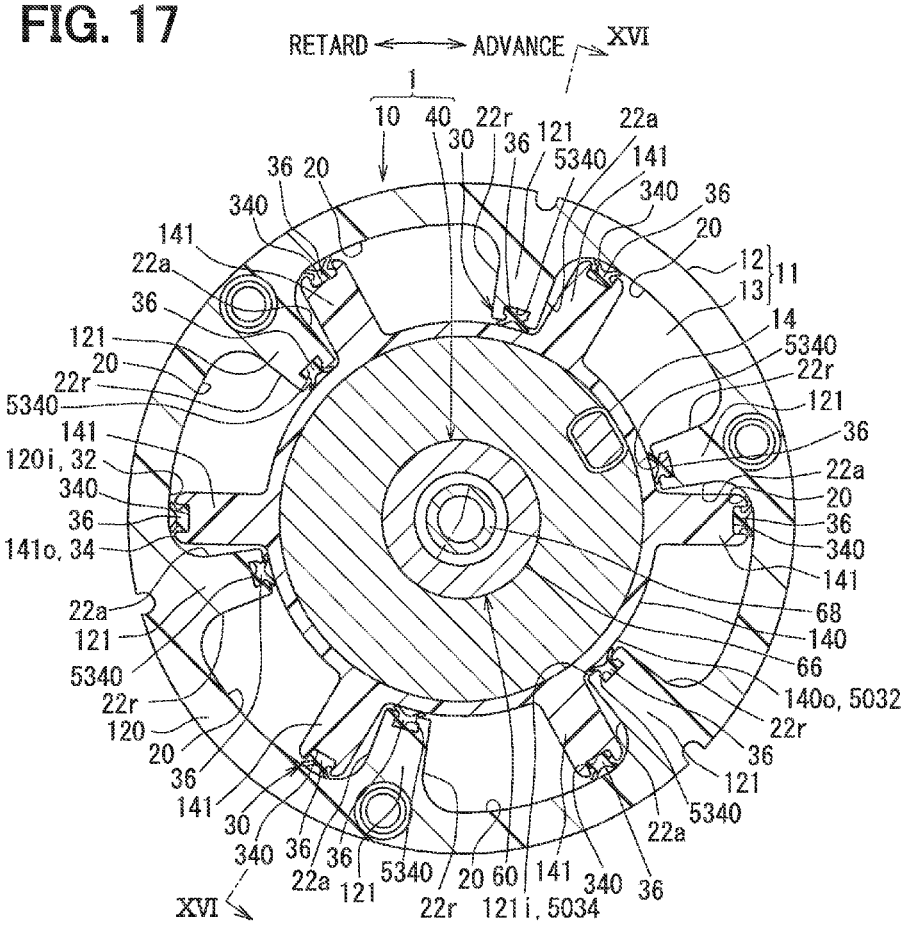
FIG. 17 is a schematic cross sectional view taken along a line XVII-XVII in FIG. 16.

As shown in FIGS. 16 and 17, a sixth embodiment is a modification in which the first embodiment and the fifth embodiment are combined together. Namely, the sealing members 36 of a first group corresponding to the first embodiment are provided at each of radial-outer ends of the vanes 141, while the sealing members 36 of a second group corresponding to the fifth embodiment are provided at each of radial-inner ends of the shoes 121. Accordingly, the same advantages to those of the first embodiment can be obtained in the sixth embodiment. In addition, since the sealing members of the first group and the sealing members of the second group are provided, the sealing effect can be further increased.

Further Embodiments and/or Modifications

The present disclosure should not be limited to the above explained embodiments but can be modified in various manners without departing from the spirit of the present disclosure.

Figure 18:
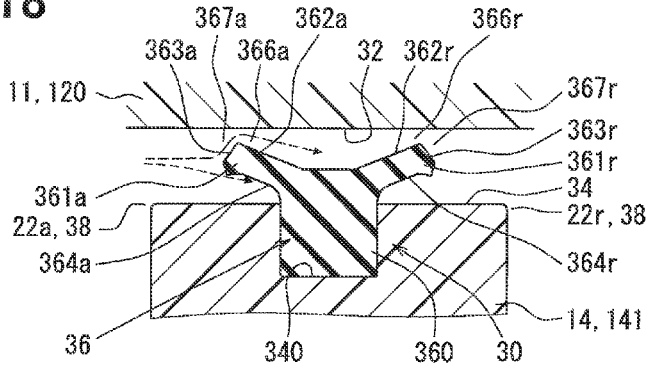
FIG. 18 is a schematically enlarged cross sectional view showing a modification of FIG. 5.

For example, as shown in FIG. 18, which is a first modification of the first embodiment (FIG. 5), the communication grooves 365*a* and 365*r* and the radial-outer end 360*e* may not be formed in the sealing member 36.

Figure 19:
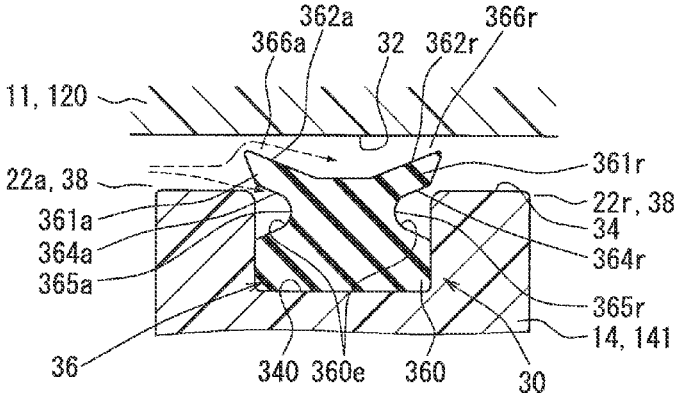
FIG. 19 is a schematically enlarged cross sectional view showing another modification of FIG. 5.

For example, in the first embodiment (FIG. 5), the guide gap 367*a*/367*r* is formed between the guide surface 363*a*/363*r* of the deformable portion 361*a*/361*r* and the sealing surface 32. However, as shown in FIG. 19, which is a second modification of the first embodiment (FIG. 5), the guide gaps 367*a* and 367*r* may not be formed in the sealing member 36.

Figure 20:
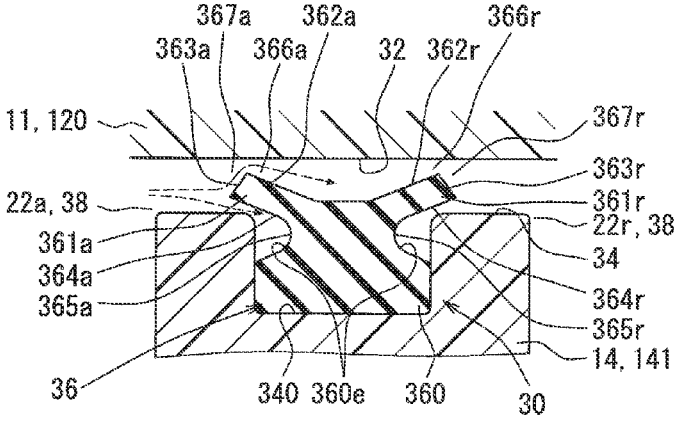
FIG. 20 is a schematically enlarged cross sectional view showing a further modification of FIG. 5.

For example, in the first embodiment (FIG. 5), the pressure-receiving surface 364*a*/364*r* is formed along the diffuser surface 362*a*/362*r* and the thickness of the forward end of the deformable portion 361*a*/361*r* on the side closer to the working chamber 38 is made larger than that of the other portions of the deformable portion 361*a*/361*r*. However, as shown in FIG. 20, which is a third modification of the first embodiment, the thickness of the forward end of the deformable portion 361*a*/361*r* may not be made larger than that of the other portions.

Figure 21:
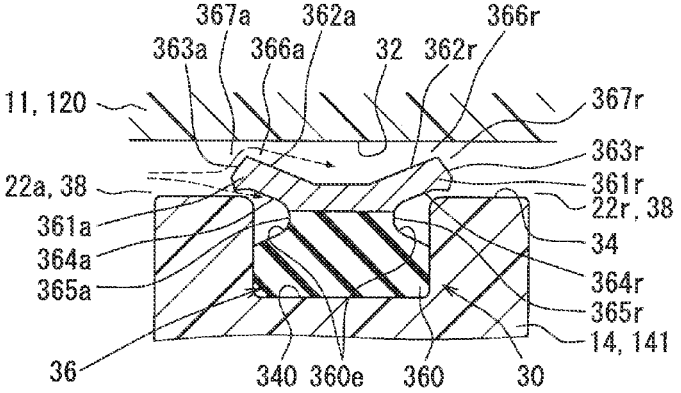
FIG. 21 is a schematically enlarged cross sectional view showing a still further modification of FIG. 5.

For example, in the first embodiment (FIG. 5), the base portion 360 is integrally formed with the first group of the portios (362*a*, 363*a*, 364*a*) for the advancing chamber 22*a* and with the second group of the portions (362*r*, 363*r*, 364*r*) for the retarding chamber 22*r*. However, as shown in FIG. 21, which is a fourth embodiment of the first embodiment, the base portion 360 may be separately formed from the first and second groups of the portions (362*a*/362*r*, 363*a*/363*r*, 364*a*/364*r*). In such a modification, the portions (362*a*, 363*a*, 364*a*) for the first group and the portions (362*r*, 363*r*, 364*r*) for the second group may be made of material (for example, metal, resin or the like) different from that of the base portion 360. In the example shown in FIG. 21, the portions (362*a*/363*r*, 363*a*/363*r*, 364*a*/364*r*) are made of metal.

Figure 22:
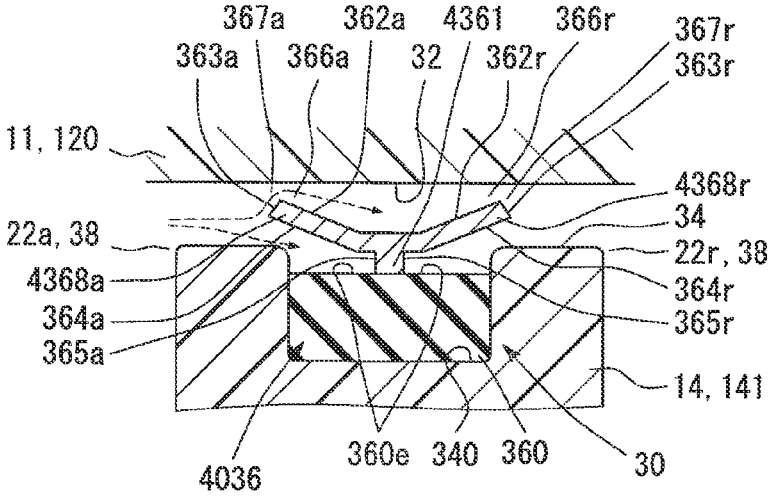
FIG. 22 is a schematically enlarged cross sectional view showing a modification of FIG. 10.

For example, in the fourth embodiment (FIG. 10), the deformable portion 4361 is integrally formed with the base portion 360. However, as shown in FIG. 22, which is a modification of the fourth embodiment, the deformable portion 4361 may be separately formed from the base portion 360. In the example shown in FIG. 22, the first group of the portions (362*a*, 363*a*, 364*a*, 4368*a*) for the advancing chamber 22*a*, the second group of the portions (362*r*, 363*r*, 364*r*, 4368*r*) for the retarding chamber 22*r* and the deformable portion 4361 may be integrally formed as one integral member.

In the second embodiment (FIG. 8), the anchoring projection 2039 is formed with the base portion 360 of the sealing member 2036 and the fitting hole 2341 is formed in the vane 141.

In the third embodiment (FIG. 9), the base portions 3360*a* and 3360*r* of the first and second sealing members 3036*a* and 3036*r* are accommodated in each of the grooves 3340*a* and

3340*r*. In a further modification of the third embodiment, an anchoring projection may be formed with each of the base portions 3360*a* and 3360*r* (like the anchoring projection 2039 of the second embodiment) and a fitting hole may be formed in each of the grooves 3340*a* and 3340*r* (like the fitting hole 2341 of the second embodiment).

Furthermore, the fourth embodiment (FIG. 10) may be modified in such a way that an anchoring projection is formed with the base portion 360 like the second embodiment (FIG. 8) or the sealing member is divided into a first sealing member for the advancing chamber 22*a* and a second sealing member for the retarding chamber 22*r* like the third embodiment (FIG. 9).

Furthermore, the fifth embodiment (FIGS. 13 to 15) may be so modified that the feature(s) of the second, the third and/or the fourth embodiment is applied to the fifth embodiment. In a similar manner, the feature(s) of the second, the third and/or the fourth embodiment may be applied to the sixth embodiment (FIGS. 16 and 17).

In the above embodiments, each of the sealing members 36, 2036, 4036 has the first group of the portions (the first deformable portion 361*a* and so on) for the advancing chamber 22*a* and the second group of the portions (the second deformable portion 361*r* and so on) for the retarding chamber 22*r*. In a further modification, only one of them (the first group of the portions or the second group of the portions) may be formed in the sealing member 36, 2036 or 4036. In the third embodiment (FIG. 9), the first and the second sealing members 3036*a* and 3036*r* are provided in each of the grooves 3340*a* and 3340*r*. However, in a further modification of the third embodiment, only either one of the first and the second sealing members 3036*a* and 3036*r* may be provided.

In a further modification for the first to sixth embodiments, the base portion 360, 3360*a* or 3360*r* may be fixed to the groove 340, 3340*a* or 3340*r* by adhesive material, burn-in, two-color molding, welding or the like. In a further modification, different shapes of the sealing members may be used for the respective grooves 340 and 5340.

What is claimed is:

1. A hydraulic-type valve timing control device for an internal combustion engine for controlling an opening and/or closing timing of a valve, in which engine torque is transmitted from a crank shaft of the engine to a cam shaft in order to open and/or close the valve, comprising:

a housing rotor to be rotated in a circumferential direction in synchronism with the crank shaft, the housing rotor having multiple shoes each of which extends in a radial-inward direction from a housing body of a cylindrical shape, the housing rotor defining multiple vane accommodating chambers in the circumferential direction between neighboring shoes;

a vane rotor to be rotated in the circumferential direction in synchronism with the cam shaft, the vane rotor being rotatably accommodated in the housing rotor so that a rotational phase of the vane rotor with respect to the housing rotor is adjusted, the vane rotor having multiple vanes each of which extends in a radial-outward direction from a rotating shaft and is accommodated in each of the vane accommodating chambers so that an advancing chamber and a retarding chamber are formed in the circumferential direction in each of the vane accommodating chamber, the rotational phase of the vane rotor being advanced when working fluid is introduced into the advancing chamber and working fluid is discharged from the retarding chamber, and the rotational phase of the vane rotor being retarded when the working fluid is introduced into the retarding chamber and the working fluid is discharged from the advancing chamber; and a sealing member supported by a holding surface and sliding on a sealing surface for sealing the advancing chamber and the retarding chamber from each other, the holding surface being formed by one of an inner peripheral surface of the housing rotor and an outer peripheral surface of the vane rotor, and the sealing surface being formed by the other of the inner peripheral surface of the housing rotor and the outer peripheral surface of the vane rotor, wherein the sealing member is composed of;

a pressure-receiving surface for receiving pressure of the working fluid from a working chamber, which is either one of the advancing chamber and the retarding chamber, the pressure of the working fluid being directed toward the sealing surface;

a diffuser surface for forming a sealing gap between the diffuser surface and the sealing surface in a radial direction of the vane rotor, the sealing gap being increased as the sealing gap is more separated from the working chamber in the circumferential direction, the diffuser surface diffusing the working fluid flowing through the sealing gap; and a deformable portion having the pressure-receiving surface and the diffuser surface, the deformable portion keeping the diffuser surface at an initial position when the pressure of the working fluid is not applied to the pressure-receiving surface so that the diffuser surface is separated from the sealing surface, the diffuser surface being more strongly pushed to the sealing surface as the pressure of the working fluid applied to the pressure-receiving surface is increased.

2. The hydraulic-type valve timing control device according to claim 1, wherein the deformable portion of the sealing member has a guide surface extending in the circumferential direction from the diffuser surface on a side to the working chamber, so as to form a guide gap between the guide surface and the sealing surface in the radial direction, the guide gap becomes smaller as the guide gap is more separated from the working chamber in the circumferential direction, and the guide surface guides the working fluid from the working chamber toward the diffuser surface.

3. The hydraulic-type valve timing control device according to claim 1, wherein the pressure-receiving surface is formed in the deformable portion on a side to the holding surface, and the diffuser surface is formed in the deformable portion on a side to the sealing surface.

4. The hydraulic-type valve timing control device according to claim 3, wherein a thickness of the deformable portion in the radial direction between the pressure-receiving surface and the diffuser surface on a side of the deformable portion closer to the working chamber is larger than that of other portions of the deformable portion.

5. The hydraulic-type valve timing control device according to claim 3, wherein a groove is formed in the holding surface, the groove being recessed in a direction opposite to the sealing surface, the sealing member has a base portion inserted into the groove, and the deformable portion, which is elastically deformable, extends from the base portion.

6. The hydraulic-type valve timing control device according to claim 5, wherein the base portion receives pressure of the working fluid from the working chamber in a direction to the groove.

7. The hydraulic-type valve timing control device according to claim 5, wherein the sealing member has an anchoring projection projecting from a bottom surface of the base portion, and the anchoring projection is fitted into a fitting hole formed in the holding surface at a bottom of the groove.

8. The hydraulic-type valve timing control device according to claim 1, wherein the sealing member has a rigid portion, which is more rigid than the deformable portion, the rigid portion swings by elastic deformation of the deformable portion, the pressure-receiving surface is formed on one of surfaces of the rigid portion on a side to the holding surface, and the diffuser surface is formed on the other of the surfaces of the rigid portion on a side to the sealing surface.

9. The hydraulic-type valve timing control device according to claim 8, wherein a groove is formed in the holding surface, the groove being recessed in a direction opposite to the sealing surface, the sealing member has a base portion inserted into the groove, and the deformable portion is formed in a slender shape and formed between the base portion and the rigid portion.

10. The hydraulic-type valve timing control device according to claim 1, wherein the sealing member has a first group of the pressure-receiving surface and the diffuser surface, which are related to the advancing chamber, the sealing member has a second group of the pressure-receiving surface and the diffuser surface, which are related to the retarding chamber, and the first group of the pressure-receiving surface and the diffuser surface and the second group of the pressure-receiving surface and the diffuser surface are integrally formed with the sealing member.

11. The hydraulic-type valve timing control device according to claim 1, wherein the sealing member is composed of a first sealing member and a second sealing member, the first sealing member has a first pressure-receiving surface and a first diffuser surface, which are related to the advancing chamber, and the second sealing member has a second pressure-receiving surface and a second diffuser surface, which are related to the retarding chamber.

* * * * *